US010485359B2

(12) United States Patent
Martin

(10) Patent No.: US 10,485,359 B2
(45) Date of Patent: Nov. 26, 2019

(54) MATTRESS FOR READY CHANGING OF BED LINEN

(71) Applicant: David John Martin, Lismore (AU)

(72) Inventor: David John Martin, Lismore (AU)

( * ) Notice: Subject to any disclaimer, the term of this patent is extended or adjusted under 35 U.S.C. 154(b) by 7 days.

(21) Appl. No.: 14/766,465

(22) PCT Filed: Feb. 7, 2014

(86) PCT No.: PCT/AU2014/000092
§ 371 (c)(1),
(2) Date: Aug. 7, 2015

(87) PCT Pub. No.: WO2014/121334
PCT Pub. Date: Aug. 14, 2014

(65) Prior Publication Data

US 2016/0022053 A1 Jan. 28, 2016

(30) Foreign Application Priority Data

Feb. 8, 2013 (AU) ..... 2013900394

(51) Int. Cl.
*A47C 31/08* (2006.01)
*A47C 21/02* (2006.01)

(52) U.S. Cl.
CPC ..... *A47C 31/08* (2013.01); *A47C 21/028* (2013.01)

(58) Field of Classification Search
CPC ..... A47C 31/08
USPC ..... 5/703, 510, 488
See application file for complete search history.

(56) References Cited

U.S. PATENT DOCUMENTS 897,979 A * 9/1908 Holding ..... A47C 31/08 16/422
1,709,995 A * 4/1929 Mulkey ..... A47C 31/08 5/703
2,666,216 A 1/1954 Schnaitter
3,952,346 A * 4/1976 Carlson ..... A47C 20/04 5/660
4,521,045 A * 6/1985 Hart ..... A47C 27/00 294/149

(Continued)

FOREIGN PATENT DOCUMENTS

AU 201100535 6/2011

OTHER PUBLICATIONS

IP Australia Examination report No. 1 for Application No. 2014214539, dated Jun. 7, 2018, 5 pages.

*Primary Examiner* — Fredrick C Conley
(74) *Attorney, Agent, or Firm* — Patent Law of Virginia, PLLC; Brian J. Teague

(57) ABSTRACT

A mattress includes a number of elongate members, webs or straps that span an underside of the mattress and terminate with graspable handle portions. The straps are attached to the underside of the mattress by a hook and loop fastening system. A mattress prop may be used in conjunction with the straps for spacing the mattress from a support surface such as a bed base. In a first version the prop has a mattress attachment member and a base abutment member movable relative to the mattress attachment member from a collapsed configuration to an erected configuration. A spacer member is disposed between the mattress attachment member and the base abutment member for selectively retaining the base abutment member in the erected configuration relative to the mattress attachment member.

16 Claims, 12 Drawing Sheets

(56) References Cited

U.S. PATENT DOCUMENTS

| | | | | | |
|---|---|---|---|---|---|
| 4,686,719 | A | * | 8/1987 | Johnson | A61G 7/1021<br>180/125 |
| 4,744,115 | A | * | 5/1988 | Marchione | A61G 7/1026<br>5/81.1 T |
| 4,807,313 | A | | 2/1989 | Ryder | |
| 5,257,430 | A | * | 11/1993 | Yamaguchi | A47C 21/028<br>254/93 HP |
| 5,860,174 | A | | 1/1999 | Failor | |
| 8,201,290 | B1 | | 6/2012 | Hooley | |
| 2005/0172406 | A1 | | 8/2005 | Post | |
| 2009/0255056 | A1 | | 10/2009 | Burnett | |
| 2012/0124752 | A1 | | 5/2012 | Patrick | |

* cited by examiner

MATTRESS FOR READY CHANGING OF BED LINEN

CROSS REFERENCE TO RELATED APPLICATION

This application is for entry into the U.S. National Phase under § 371 for International Application No. PCT/AU2014/000092 having an international filing date of Feb. 7, 2014, and from which priority is claimed under all applicable sections of Title of the United States Code including, but not limited to, Sections 120, 363, and 365(c), and which in turn claims priority under 35 USC 119 to Australian Patent Application No. 2013900394 filed on Feb. 8, 2013.

TECHNICAL FIELD

The present invention relates to a mattress and more particularly to a mattress that is adapted to be readily lifted and moved and which, in a preferred embodiment assists in the changing of bed linen.

BACKGROUND ART

Any references to methods, apparatus or documents of the prior art are not to be taken as constituting any evidence or admission that they formed, or form part of the common general knowledge.

Mattresses for beds are difficult objects to handle. Typically they are formed of plurality of internal metal springs which are interconnected by a mesh. The coils and mesh are then covered with a layer of flexible foam which is in turn covered by an outer fabric layer. Consequently mattresses are relatively heavy and difficult to grasp easily. Furthermore, since they are flexible they may twist out of a person's grasp in an unpredictable fashion.

In some situations there is a need to handle a large number of mattresses very frequently. One example of such a situation is the hotel industry where large numbers of beds must be made up with fresh bed linen. Obviously the more time that it takes to change a bed the more personnel are required and the greater the associated overhead.

In the past some attempts have been made to provide a mattress which is adapted for improved handling. One approach has been to include handles on opposed sides of the mattress. In some instances the handles include members that penetrate through the fabric and foam layers to terminate fast with the internal mesh. It will be realized that it is difficult and expensive to manufacture mattresses of this type. Furthermore, while such mattresses may assist in addressing the problem of moving an unmade mattress from one place to another, they do not generally assist in handling a mattress that bears a fitted sheet.

It is an object of the present invention to provide a mattress that addresses one or more of the above described problems or which is at least a useful alternative to those mattresses that have hitherto been known in the prior art.

SUMMARY OF THE INVENTION

According to a first aspect of the present invention there is provided a mattress including:

a number of flexible handling members attached to an underside of the mattress with graspable portions for manually for raising the mattress.

Preferably the flexible handling members comprise elongate webs or straps that span an underside of the mattress.

In a preferred embodiment of the invention the flexible handling members are attached to the underside of the mattress sufficiently to keep them in place relative thereto.

For example, in a preferred embodiment of the invention the flexible handling members are attached to the underside of the mattress by a hook and loop fastening system. Alternatively, the flexible handling members may be sewn or adhered directly to the mattress.

The hook and loop fastening system may comprise an elongate portion between the mattress and the flexible handling members or alternatively it may comprise a number of separate portions.

Preferably the flexible handling members have outer ends that terminate in handles comprising the graspable portions. For example, in a preferred embodiment of the invention the handles comprise loops formed at outer ends of the flexible handling members.

Preferably the mattress includes at least one mattress prop for raising the mattress from a support surface thereof.

In one embodiment the mattress prop comprises an inflatable bladder which assumes an erected configuration upon inflation wherein the mattress is raised from the support surface.

In an alternative and preferred embodiment of the invention the mattress prop includes a mattress support member and a base member movably attached thereto for moving from a collapsed configuration to an erected configuration.

Preferably the base member is movably attached to the mattress support member by a pivot.

In the preferred embodiment of the invention a spacer member is disposed between the mattress support member and the base member for retaining the mattress prop in an erected configuration.

Preferably the mattress support member includes a formation to retain the spacer member in the erected configuration.

It is preferred that the mattress includes four of the mattress props.

In a preferred embodiment of the invention the mattress support member is fastened to one of the flexible handling members. For example, the mattress support member may be riveted to said handling member.

According to a further aspect of the present invention there is provided a mattress prop for spacing a mattress from a support surface such as a bed base, said prop comprising:

a. a base abutment member;

b. a mattress support member movable relative to the base abutment member from a collapsed configuration to an erected configuration; and c. a spacer member disposed between the mattress support member and the base abutment member for selectively retaining the mattress support member in the erected configuration relative to the base abutment member.

Preferably a first end of the mattress support member and a first end of the base abutment member are joined together by a first pivot.

The first end of the spacer member is preferably attached to a second end of the base abutment member by a second pivot.

Preferably the second end of the spacer member is slidingly engaged by the mattress support member.

The spacer member may be slidingly engaged by a slot formed along the mattress support member.

Preferably the slot is formed with a retaining portion that acts as a detent for retaining the spacer member in the erected configuration.

According to a further aspect of the present invention there is provided a mattress assembly including a base;

a mattress;

an inflatable prop disposed between the base and the mattress comprising an inflatable bladder which assumes an erected configuration upon inflation for raising the mattress from the base.

According to a further aspect of the present invention there is provided a method for changing bed linen comprising the steps of:

locating props at or toward the underside of four corners of a mattress;

bringing the props to an erected configuration to thereby space at least the corners of the mattress from an underlying support surface;

changing the bed linen whilst the props are in the erected configuration;

once the bed linen has been changed bringing the props to a collapsed configuration.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF EXEMPLARY EMBODIMENTS

Figure 1:
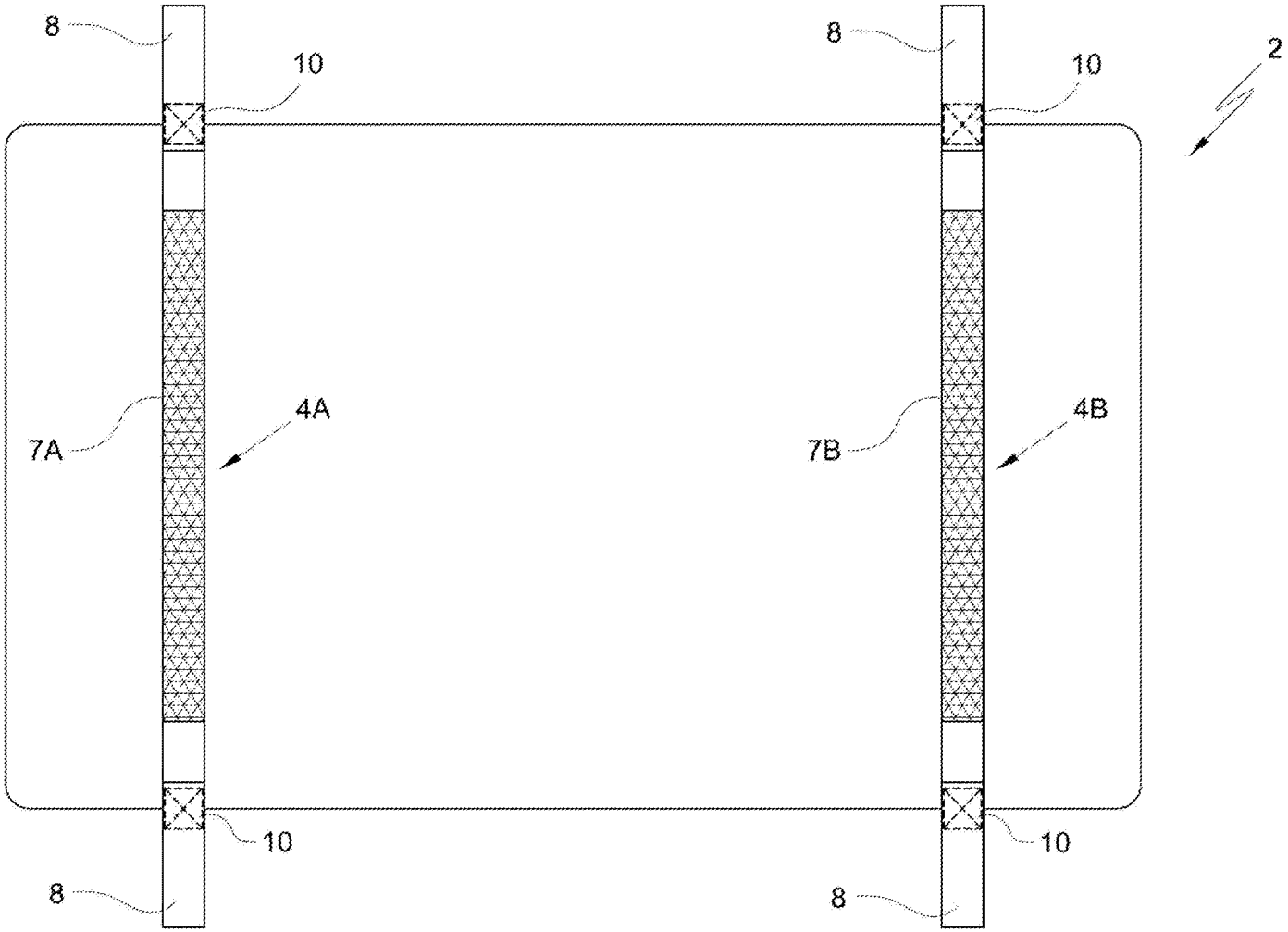
FIG. 1 is a plan view of the underside of a mattress according to a preferred embodiment of the present invention.

Reference will now be made to FIG. 1, which is a plan view of the underside of a mattress 2 according to a preferred embodiment of the present invention. Spanning across the width of the underside of the mattress are two spaced apart flexible handling members in the form of straps 4*a* and 4*b*. The straps are typically made of a strong woven fabric, for example the type of woven material that is used to make vehicle seat belts.

Medial portions 7*a*, 7*b* of each of the straps are fastened to the underside of the mattress with a hook-and-loop fastening system such as Velcro.

Figure 2:
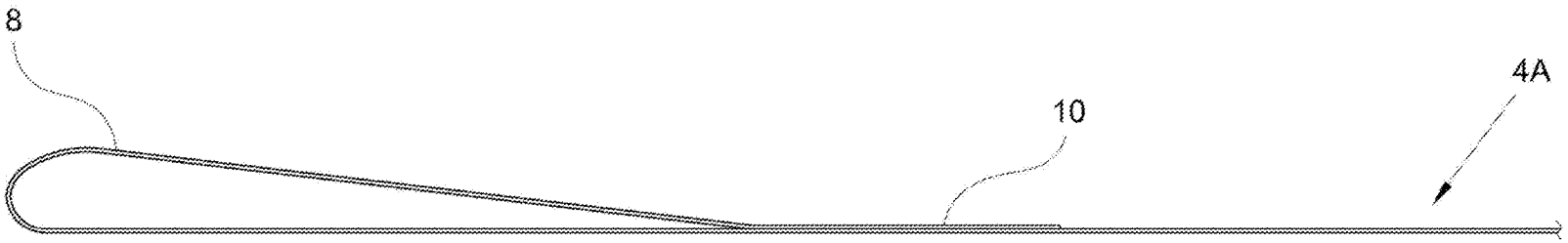
FIG. 2 is a side view of a handle portion of straps of the mattress of FIG. 1.
Figure 3:
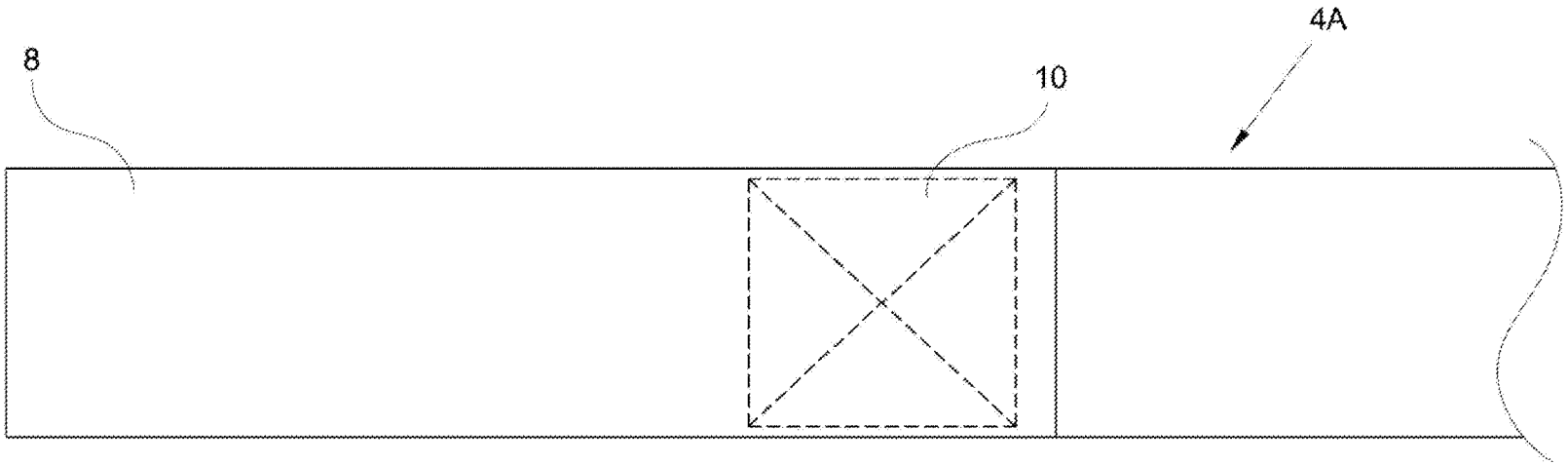
FIG. 3 is a plan view of the handle portion of FIG. 2.

Referring now to FIGS. 2 and 3, the ends of each of the straps 4*a* and 4*b* are portions for grasping by hand. More particularly, they are formed as loops 8 which comprise handles. Each loop 8 is made simply by folding ends of each of the straps back upon themselves and then stitching them in place as shown in region 10, to thereby form the loop.

Figure 4:
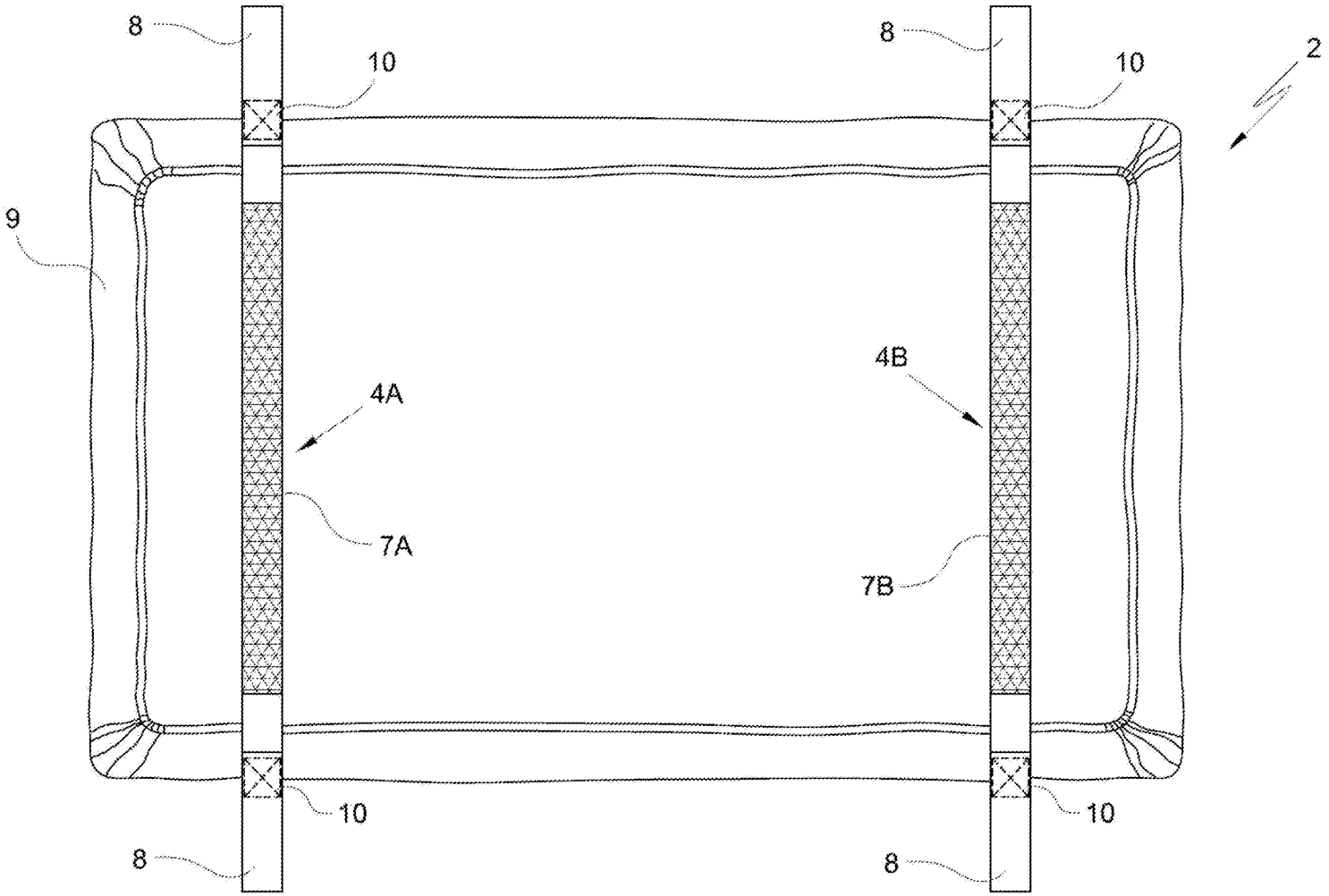
FIG. 4 is a plan view of the underside of the mattress of FIG. 1 with a fitted sheet installed.

FIG. 4 shows the underside of the mattress 2 with a fitted sheet 9 installed thereon. It will be noted that the portions 7*a*, 7*b* of each strap that are fastened to the underside of the mattress do not extend to the edge of the mattress but rather terminate sufficiently inward from the mattress edge so that they do not interfere with fitted sheet 9.

Since the straps 4*a*, 4*b* and loops 8 are flexible they can be easily tucked into, or pulled out from, fitted sheet 9 without having to remove the fitted sheet from the mattress. Alternatively, they can be simply folded back under the mattress.

It is preferable that each of the straps be placed underneath the mattress a minimum of 200 mm in from the sides and 300 mm to 400 mm from the head and foot ends of the mattress. If the straps are attached closer to the head end of the mattress then they are likely to be difficult to use as they may be obstructed by bedside tables and the like.

Figure 4A:
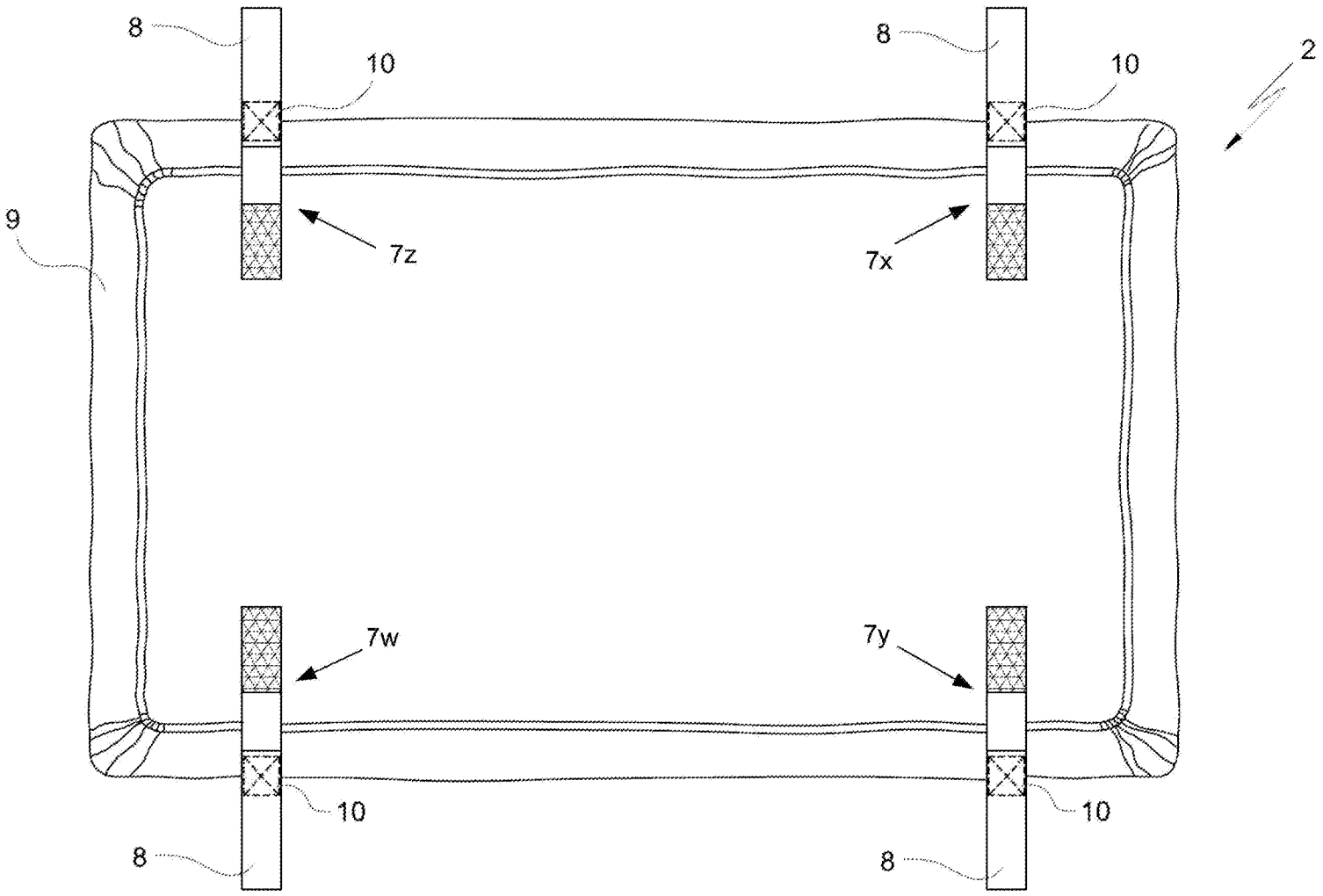
FIG. 4A is a plan view of the underside of the mattress where straps that do not span the width of the mattress have been fitted in accordance with a less preferred embodiment of the invention.

Furthermore, it is also preferable that a continuous length of fabric be used for each strap which spans the underside of the mattress and terminates in loops or other types of handle at either end. In a variation of the invention shown in FIG. 4A of the invention four distinct straps 7*x*, 7*y*, 7*z* and 7*w* are used, each attached near a corner of the underside of the mattress. However, such an arrangement is more likely to damage the mattress as the lifting load is not as well distributed as it is by using continuous straps 7A, 7B (of FIG. 4) that span the underside of the mattress.

It is also possible, in another variation of the invention, for the straps to be orientated so that they span from the head to the foot of the mattress, rather than from side to side. However, while such an arrangement is possible, having an end of the straps at the head is likely to be inconvenient since the head of a bed is usually placed against a wall or bedhead so that access to the loops of the straps may be obstructed.

Figure 4B:
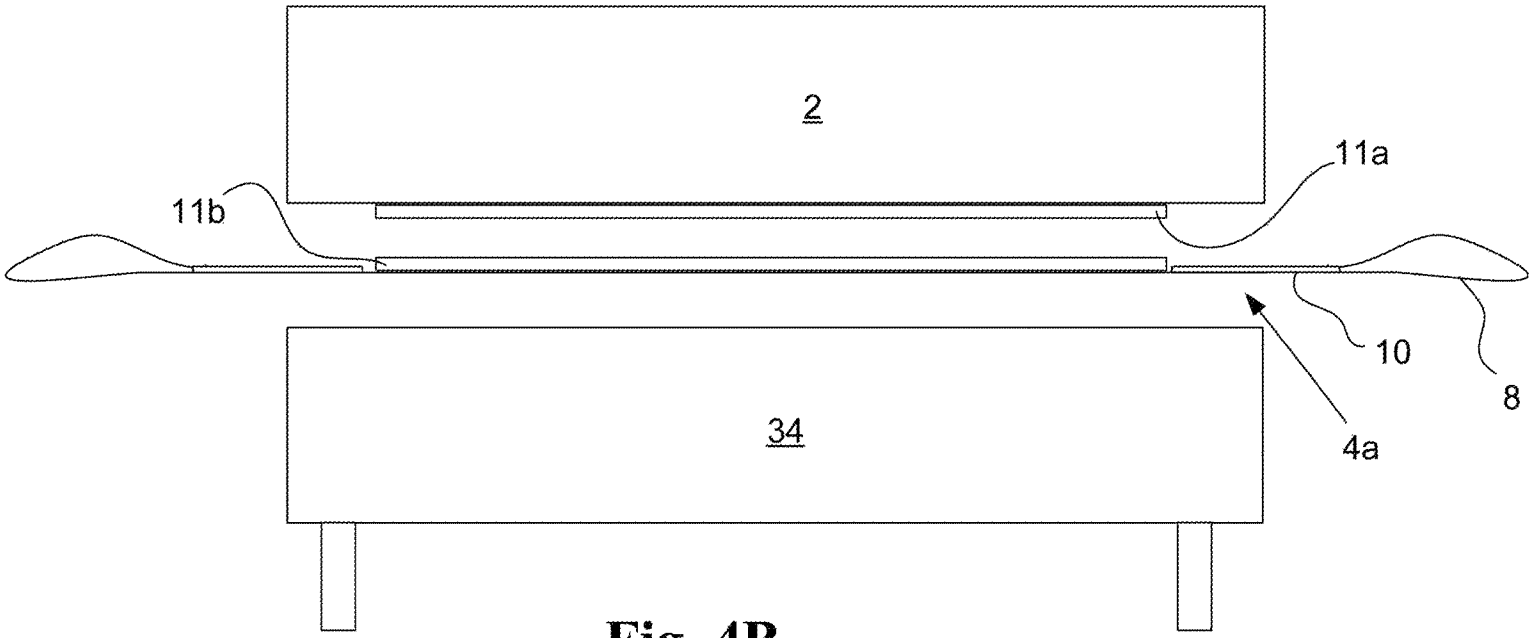
FIG. 4B is a side and partially exploded view of the mattress above a base showing a continuous hook and loop fastening system.

Referring now to FIG. 4B, there is shown an exploded side view, which is not necessarily drawn to scale, of the mattress, base and strap wherein the two parts of the hook and loop fastening system 11*a* and 11*b*, which respectively are attached to the strap and to the mattress can be seen.

Figure 4C:
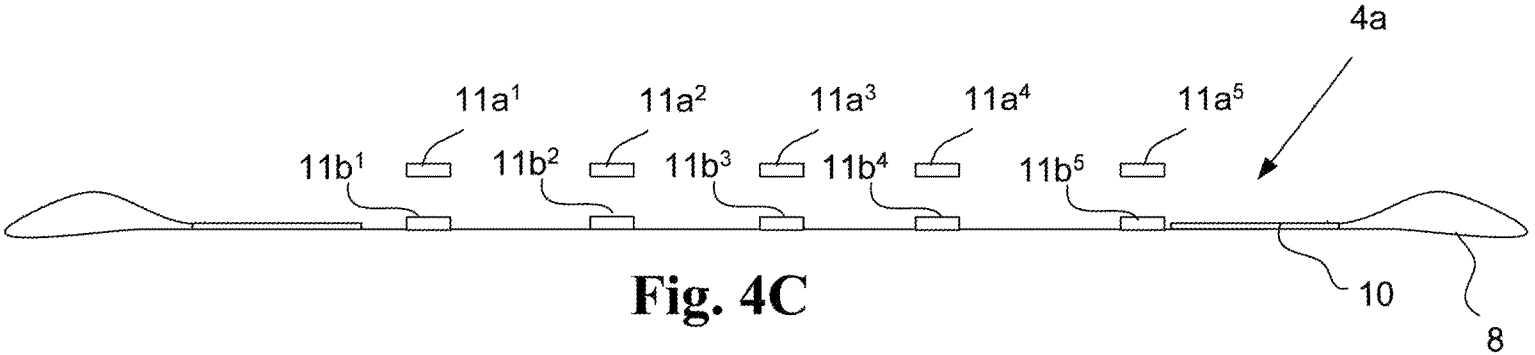
FIG. 4C shows a variation wherein the hook and loop fastening system comprises a plurality of separate regions.

It is not necessary that the straps be attached to the underside of the mattress all the way across the underside. FIG. 4C shows a variation wherein distinct patches of the hook and loop fastening system are used. Furthermore, while a hook and loop fastening system is preferred the straps could be sewn or glued directly to the mattress.

A mattress prop according to a preferred embodiment of a further aspect of the present invention will now be described with reference to FIGS. 5 to 10.

Figure 5:
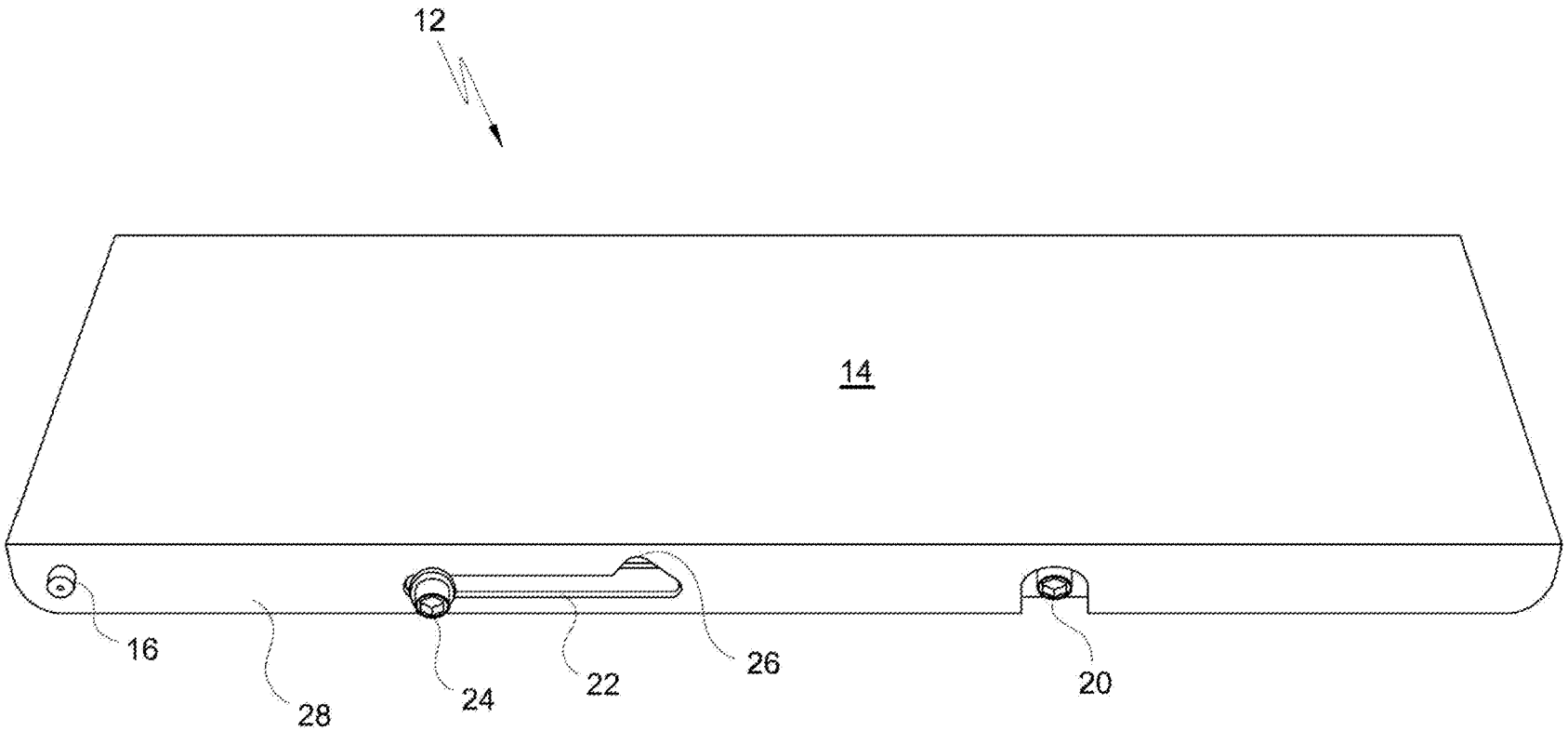
FIG. 5 depicts a mattress prop according to a preferred embodiment of a second aspect of the invention.
Figure 6:
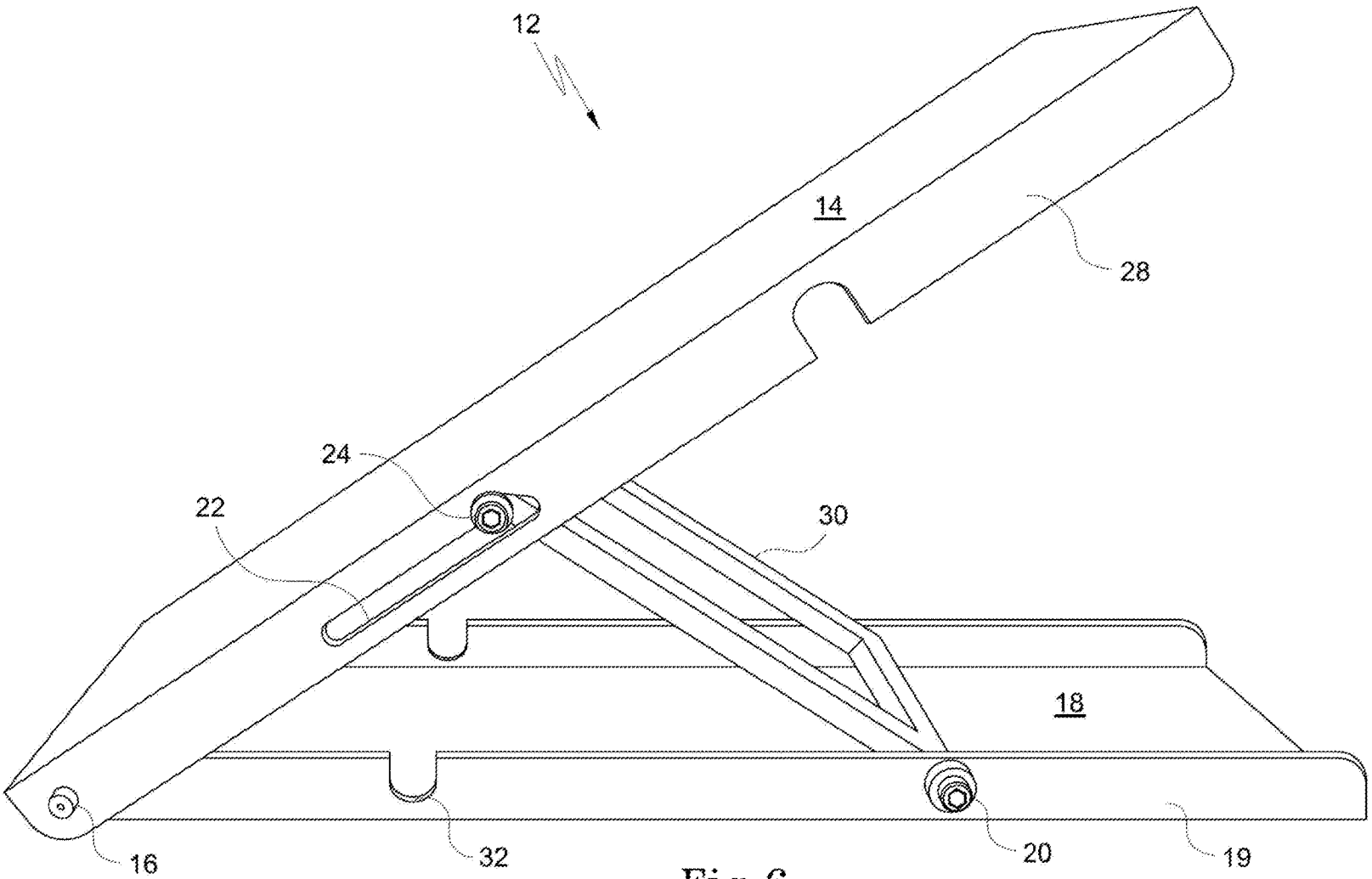
FIG. 6 shows the mattress prop of FIG. 5 in an erected configuration.

Referring now to FIGS. 5 and 6, the mattress prop 12 comprise opposed members in the form of a mattress support member comprising mattress plate 14 and a base abutment member comprising a base plate 18 (best seen in FIG. 6). The plates 14 and 18 are joined at one end by a pivot 16, which allows the plates to swing away and toward each other from a collapsed configuration, shown in FIG. 5 to an erected configuration as shown in FIG. 6.

Mattress plate 14 is formed with sides 28 along each of which an elongate slot 22 is formed therethrough. The slot 22 captures the head 24 of a pin about which one end of a spacer member 30 pivots. An opposite end of the spacer member 30 is connected, by pivot 20 to sides 19 of the base plate 18 at a distance from pivot 16.

The base plate 18 is formed with upright sides 19 into each of which there is formed a slot 32 for receiving the pin heads 24 when the mattress prop 12 is in the collapsed configuration shown in FIG. 5.

At one end of the slot 22, remote from pivot 16, the slot terminates in a right angled bend which acts as a retaining formation or detent 26. The detent 26 receives and captures the pin 24, and so the spacer member 30, in the erected configuration of the prop which is shown in FIG. 6.

Figure 8:
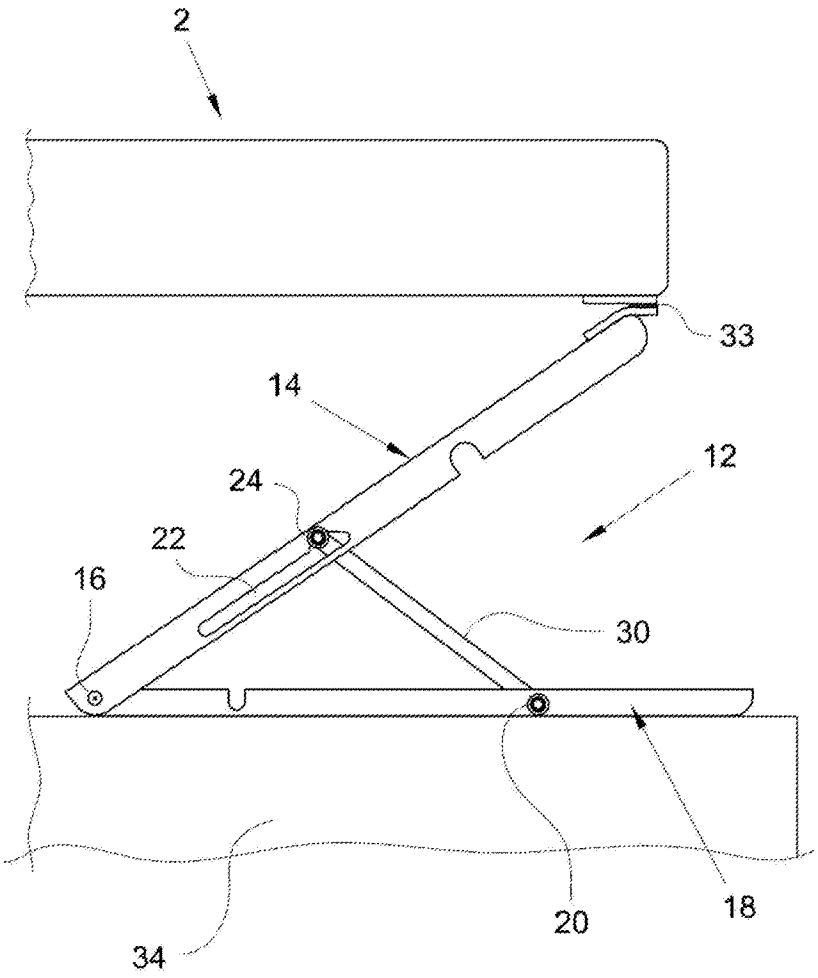
FIG. 8 is a side view of the mattress prop of FIG. 5 in use and in an erected configuration.
Figure 7:
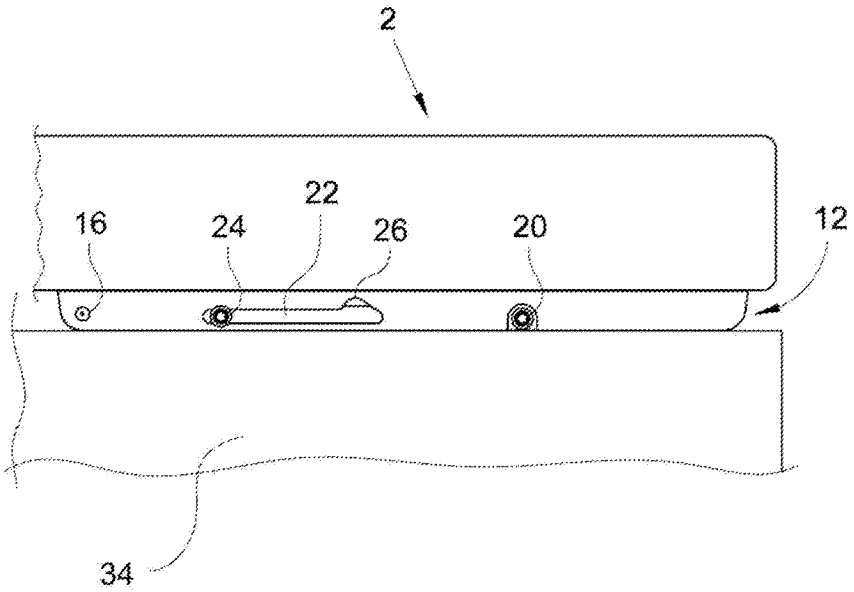
FIG. 7 is a side view of the mattress prop of FIG. 5 in use and in a collapsed configuration.

Referring now to FIGS. 7 and 8, in use a leading edge of the mattress plate 14 of the prop 12 supports the underside of the mattress 2. In the preferred embodiment shown in FIG. 8, not only does the mattress plate 14 support the underside of the mattress 2 but it is also attached to the underside of mattress 2 by a hook and loop fastening system 33 (such as Velcro®) wherein a first part of the fastening system is glued to the plate 14 and a second part of the fastening system is sewn, glued or otherwise attached to the underside of the mattress 2.

In use, a person wishing to change the bed linen lifts the mattress 2 and so brings plate 14 of mattress prop 12 upward. Alternatively, if the hook and loop system 33 is not used the person could instead lift the leading end of the mattress plate 14. Consequently, the mattress plate 14 swings up around pivot 16. As it does so the spacer member 30 swings about pivot 20 and the pin head 24 slides along slot 22 until it is captured by detent 26 thereby coming to the erected position shown in FIG. 8.

In the erected configuration illustrated in FIG. 8 the person is able to easily remove and refit the bed linen since the mattress 2 is held spaced apart from the base 34 as shown. It is preferable that one of the props 12 be used at each of the four corners of the mattress.

Once the bed linen has been changed the person then raises mattress 2 (or raises the leading edge of mattress plate 14 and so also the mattress 2) so that the pin head 24 falls out from the detent 26 and is able to slide back along slot 22 as the prop 12 resumes the collapsed configuration illustrated in FIG. 7.

Although it is not essential, preferably the mattress prop 12 is used in conjunction with a mattress that has straps and is as of the type explained in FIGS. 1 to 4.

Figure 9:
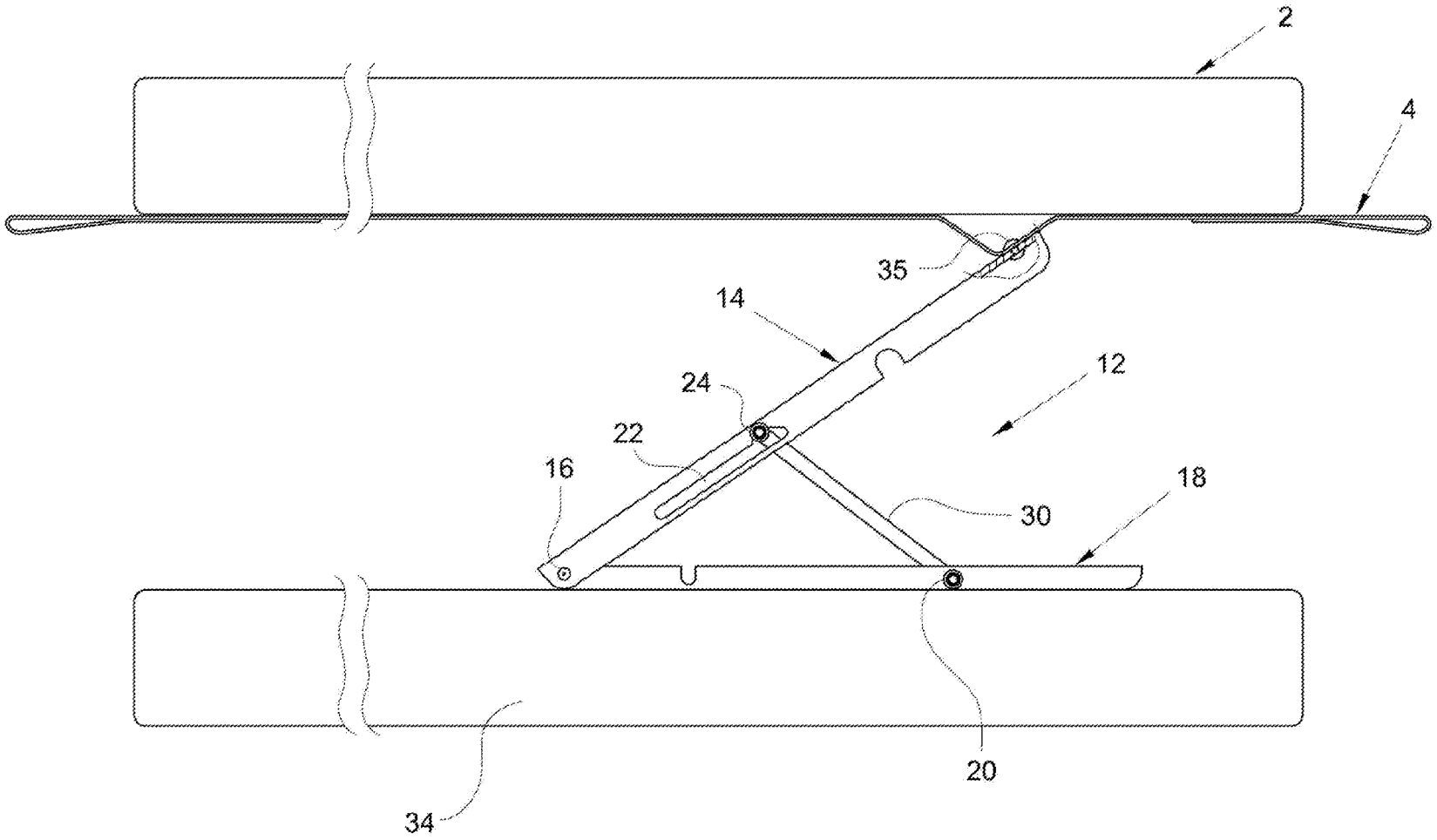
FIG. 9 is a somewhat stylized side view of the mattress prop of FIG. 5 in use in conjunction with mattress straps of FIG. 1.

FIG. 9 is a sideview of a portion of a mattress 2 fitted with strap 4 and mattress prop 12. The upper edge of mattress plate 14 in this embodiment is riveted to strap 4 by means of a rivet 35, although other attachment means may also be employed. Consequently, lifting one end of the strap also causes the adjacent mattress plate 14 of prop 12 to rise so that the erected configuration shown in FIG. 9 is achieved.

Figure 9A:
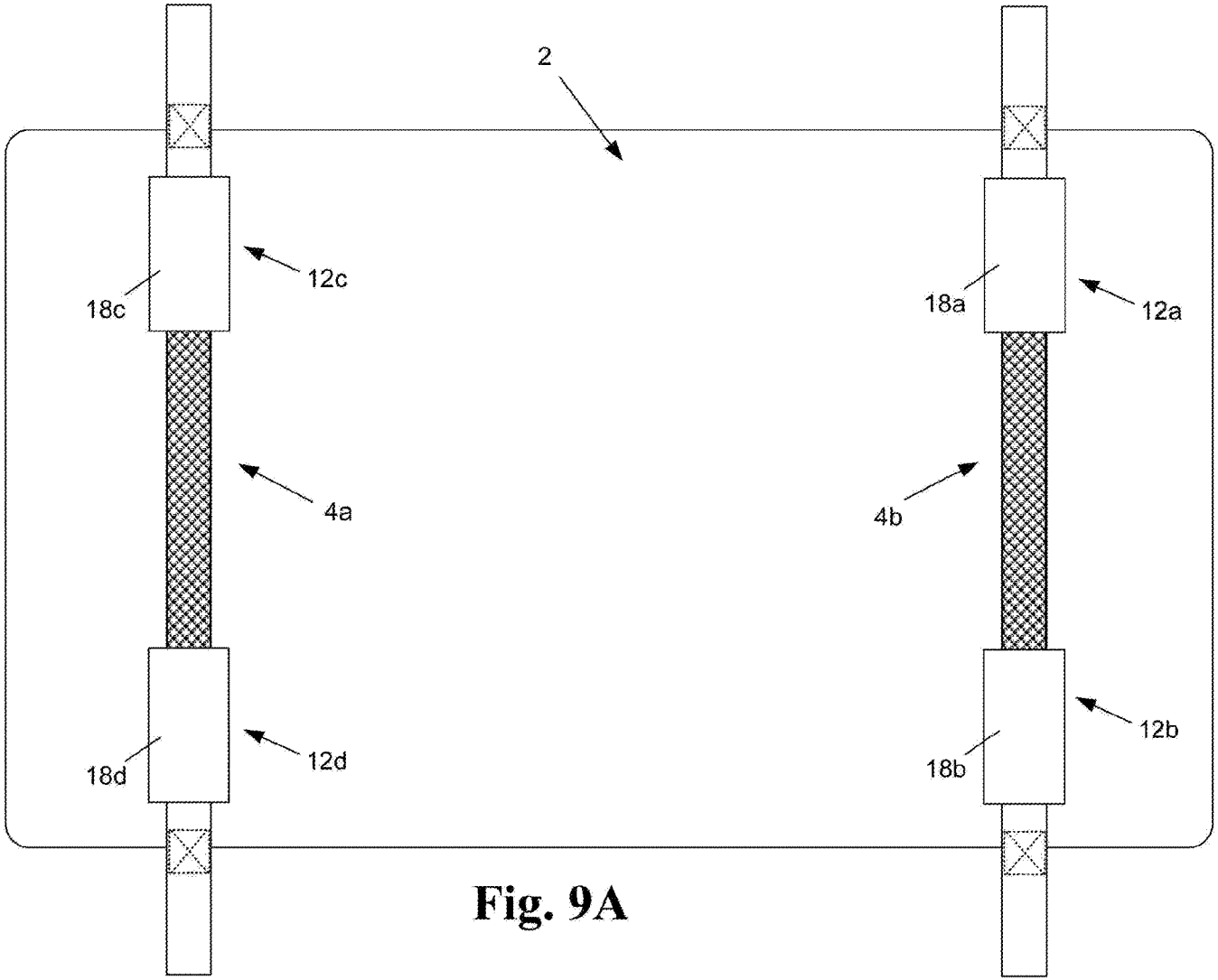
FIG. 9A depicts the underside of the mattress of FIG. 9 wherein four props 12*c* are positioned thereunder.

FIG. 9A shows the underside of a mattress where four of the props 12*a* . . . 12*b* have been disposed towards each of the corners of the mattress and fastened to the lifting straps 4*a*, 4*b* as shown in FIG. 9.

Figure 11:
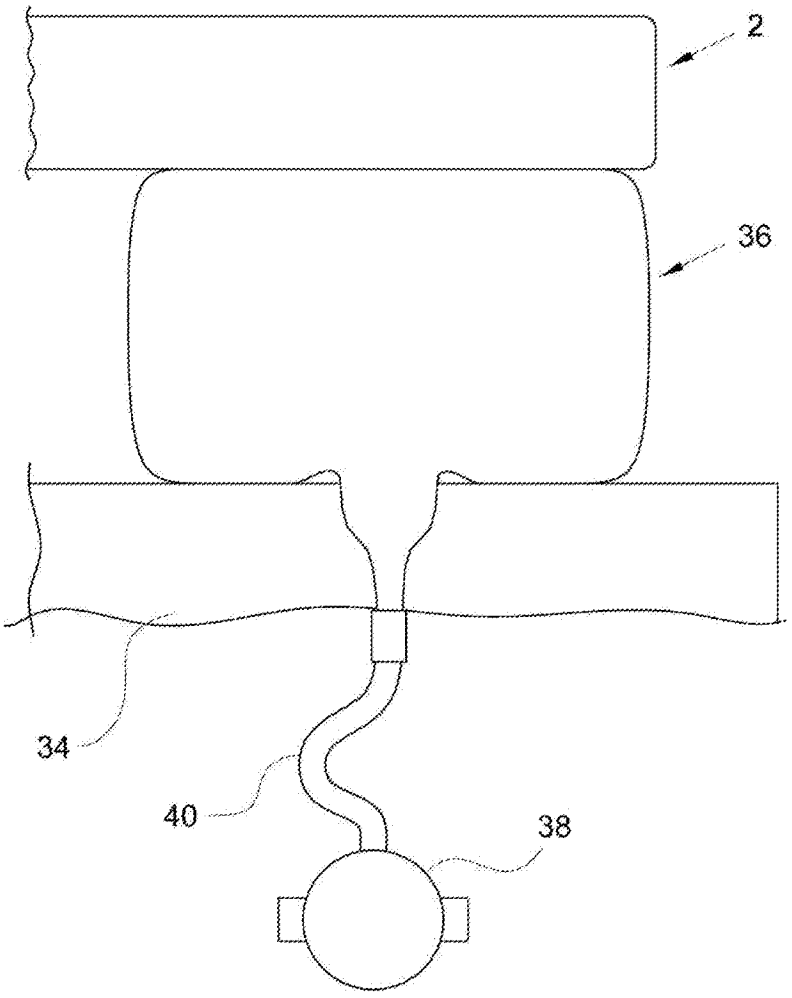
FIG. 11 is a side view of the mattress prop of FIG. 10 in a second, erected, configuration.
Figure 10:
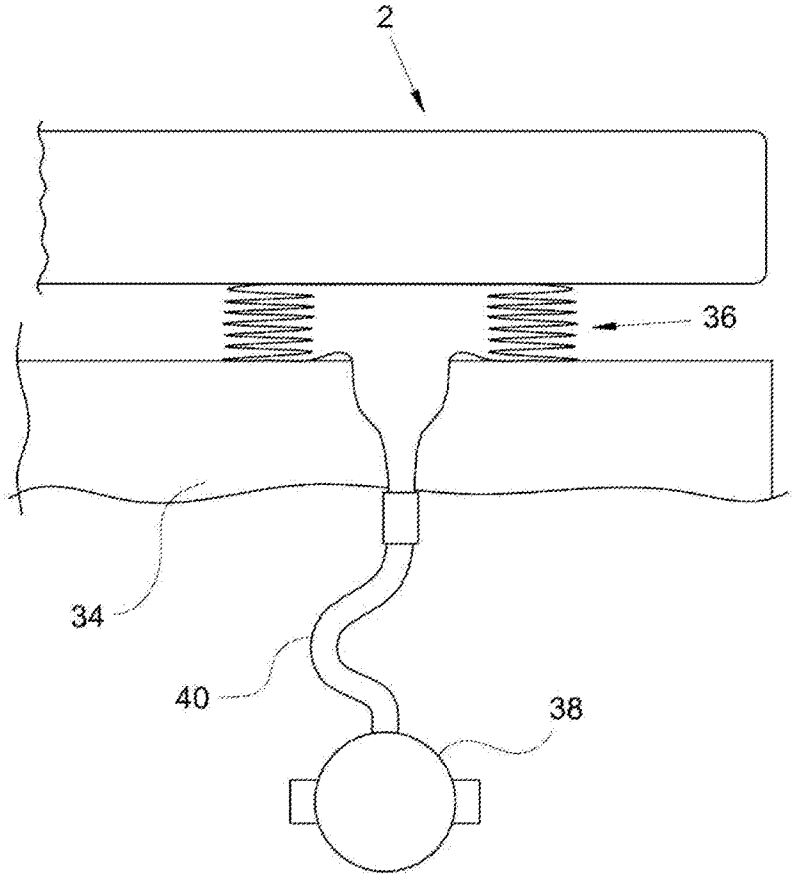
FIG. 10 is a side view of a mattress prop according to a second embodiment of the present invention in a first, collapsed, configuration.

Referring now to FIGS. 10 and 11, there is depicted an alternative embodiment of a mattress prop being an inflatable bladder 36. The inflatable bladder is made of a tough, resilient and deformable material such as a suitable plastic envelope and is connected to a fluid pump 38, e.g. an air pump, by a hose 40.

Figure 11A:
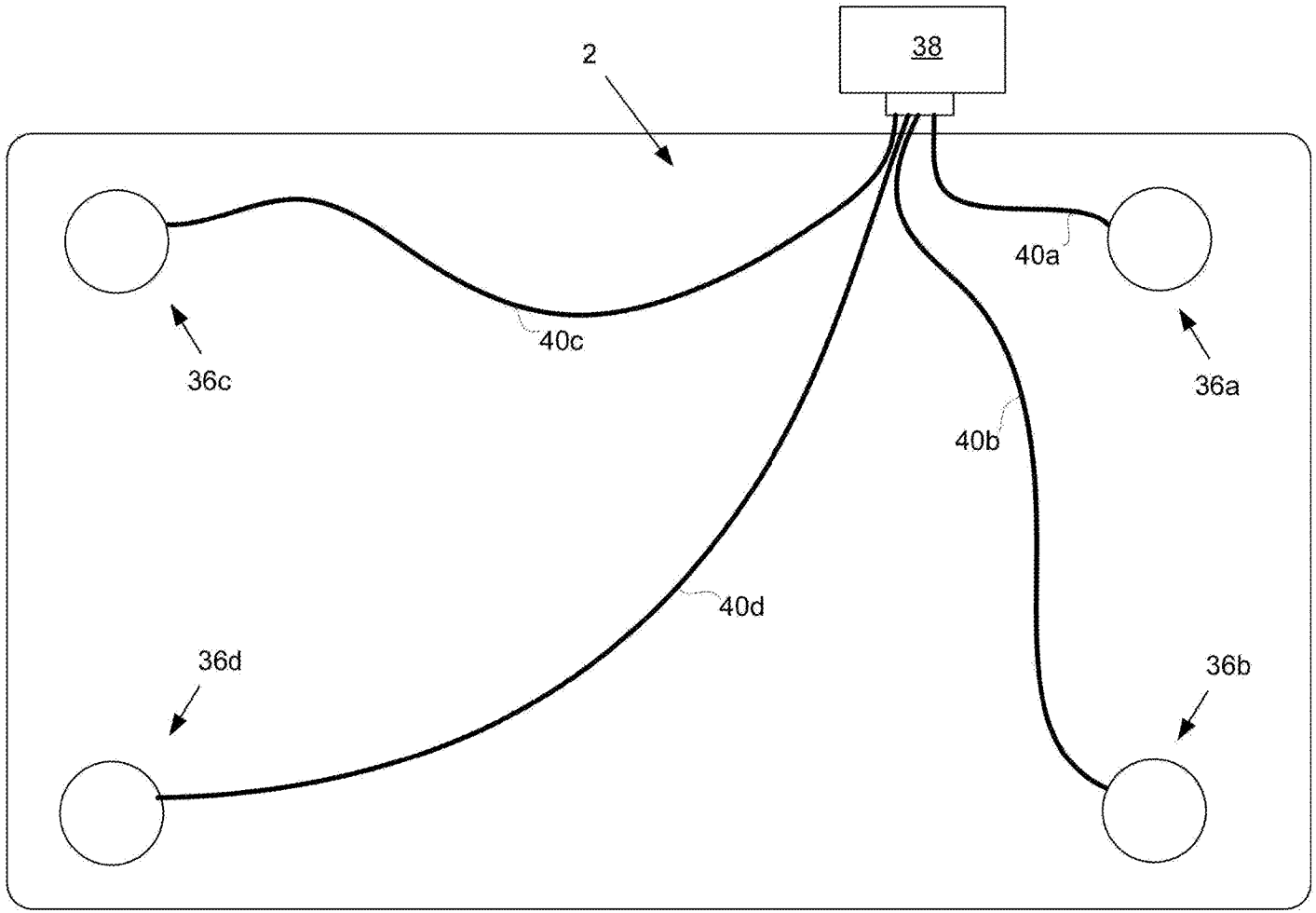
FIG. 11A is a plan view of the underside of a mattress with four of the mattress pumps of FIGS. 10 and 11 located thereunder.

The pump 38 may be motor or foot driven. FIG. 11A shows the preferred situation where four of the mattress pumps 36*a* to 36*d* are used, each toward or at a corner of the underside of the mattress 2.

As shown in FIG. 11A, the props are preferably all connected by their hoses 40*a* to 40*d* to a common pump 38.

In use, an operator starts the pump 38 to cause inflation of the bladders 36*a* to 36*c* so that the mattress 2 rises from the base 34 to a suitable height wherein the sheet over the mattress can be readily changed. Once the bed linen has been changed the bladder is allowed to deflate, for example by disconnecting hoses 40*a* to 40*d* from the pump or by turning off the pump 38.

In compliance with the statute, the invention has been described in language more or less specific to structural or methodical features.

The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

The invention claimed is:

1. A mattress having a non-removable cover, the mattress including:

a number of flexible handling members directly attached to an underside of the mattress with graspable portions for manually raising the mattress sufficiently to enable bed linen to be fitted, the handling members having free outer ends and being directly attached to an external surface of the mattress at a minimum spacing inwardly from the edge of the mattress along a longitudinal axis of each handling member to avoid interference with fitting of the bed linen, and the graspable portions being disposed at the free outer ends of respective handling members.

2. A mattress according to claim 1, wherein the flexible handling members comprise elongate webs or straps that span an underside of the mattress.

3. A mattress according to claim 1, wherein the flexible handling members are sewn, adhered or otherwise directly attached to the mattress.

4. A mattress according to claim 1, wherein the flexible handling members are attached to the underside of the mattress by a hook and loop fastening system.

5. A mattress according to claim 4, wherein the hook and loop fastening system comprises an elongate portion between the mattress and the flexible handling members.

6. A mattress according to claim 4, wherein the hook and loop fastening system comprises a number of separate portions.

7. A mattress according to claim 1, wherein the free outer ends of each of the flexible handling members that terminate in handles.

8. A mattress according to claim 7, wherein the handles comprise loops formed at the free outer ends of the flexible handling members.

9. A mattress as claimed in claim 1, wherein the handling members are attached inwardly from the edge of the mattress by at least about 20 cm.

10. A mattress according to claim 1, including at least one mattress prop for raising the mattress from a support surface therefor.

11. A mattress according to claim 10, wherein the mattress prop includes a mattress support member and a base abutment member movably attached thereto for moving from a collapsed configuration to an erected configuration.

12. A mattress according to claim 11, wherein the base member is movably attached to the mattress support member by a pivot.

13. A mattress according to claim 12, wherein a spacer member is disposed between the mattress support member and the base member for retaining the mattress prop in an erected configuration.

14. A mattress according to claim 13 wherein the mattress support member includes a formation to retain the spacer member in the erected configuration.

15. A mattress according to claim 10, wherein the mattress prop comprises an inflatable bladder which assumes an erected configuration upon inflation wherein the mattress is raised from the support surface.

16. An assembly including a mattress and four of the mattress props according to claim 15.

* * * * *